United States Patent [19]

Jansz, deceased

[11] 4,279,313

[45] Jul. 21, 1981

[54] UNDER WATER PILE DRIVER

[75] Inventor: Joost W. Jansz, deceased, late of The Hague, Netherlands, by Henriëtte C. Jansz-de l'Ecluse, heir

[73] Assignee: Hollandsche Beton Groep N.V., Rijswijk, Netherlands

[21] Appl. No.: 31,093

[22] Filed: Apr. 18, 1979

[30] Foreign Application Priority Data

Apr. 19, 1978 [NL] Netherlands ..... 7804172

[51] Int. Cl.[3] ..... E02D 7/10

[52] U.S. Cl. ..... 173/112; 173/DIG. 1

[58] Field of Search ..... 173/DIG. 1, 112, 116, 173/134, 135, 138, 127, 133; 175/6, 92, 93, 94, 101, 8, 10

[56] References Cited

U.S. PATENT DOCUMENTS

| | | | |
|---|---|---|---|
| 26,073 | 11/1859 | Whipple | 173/DIG. 1 |
| 1,217,254 | 2/1917 | Winslow | 173/DIG. 1 |
| 2,904,964 | 9/1959 | Kupka | 173/DIG. 1 |
| 2,915,284 | 12/1959 | Ortloff | 175/92 |
| 3,279,547 | 10/1966 | Berne et al. | 175/6 |
| 3,998,064 | 12/1976 | Jansz | 173/112 X |
| 4,043,405 | 8/1977 | Kuhn | 173/DIG. 1 X |
| 4,126,191 | 11/1978 | Gendron et al. | 173/DIG. 1 |

FOREIGN PATENT DOCUMENTS 7513240 5/1976 Netherlands .

*Primary Examiner*—Werner H. Schroeder
*Assistant Examiner*—Andrew M. Falik
*Attorney, Agent, or Firm*—Sughrue, Rothwell, Mion, Zinn and Macpeak

[57] ABSTRACT

Apparatus for under water pile driving comprises a pile hammer and a drive unit connected by high pressure hoses to the hammer. The hammer is guided for relative vertical movement within an auxiliary guide frame on top of which the drive unit is permanently attached, said frame being suspended from a hoisting device.

3 Claims, 1 Drawing Figure

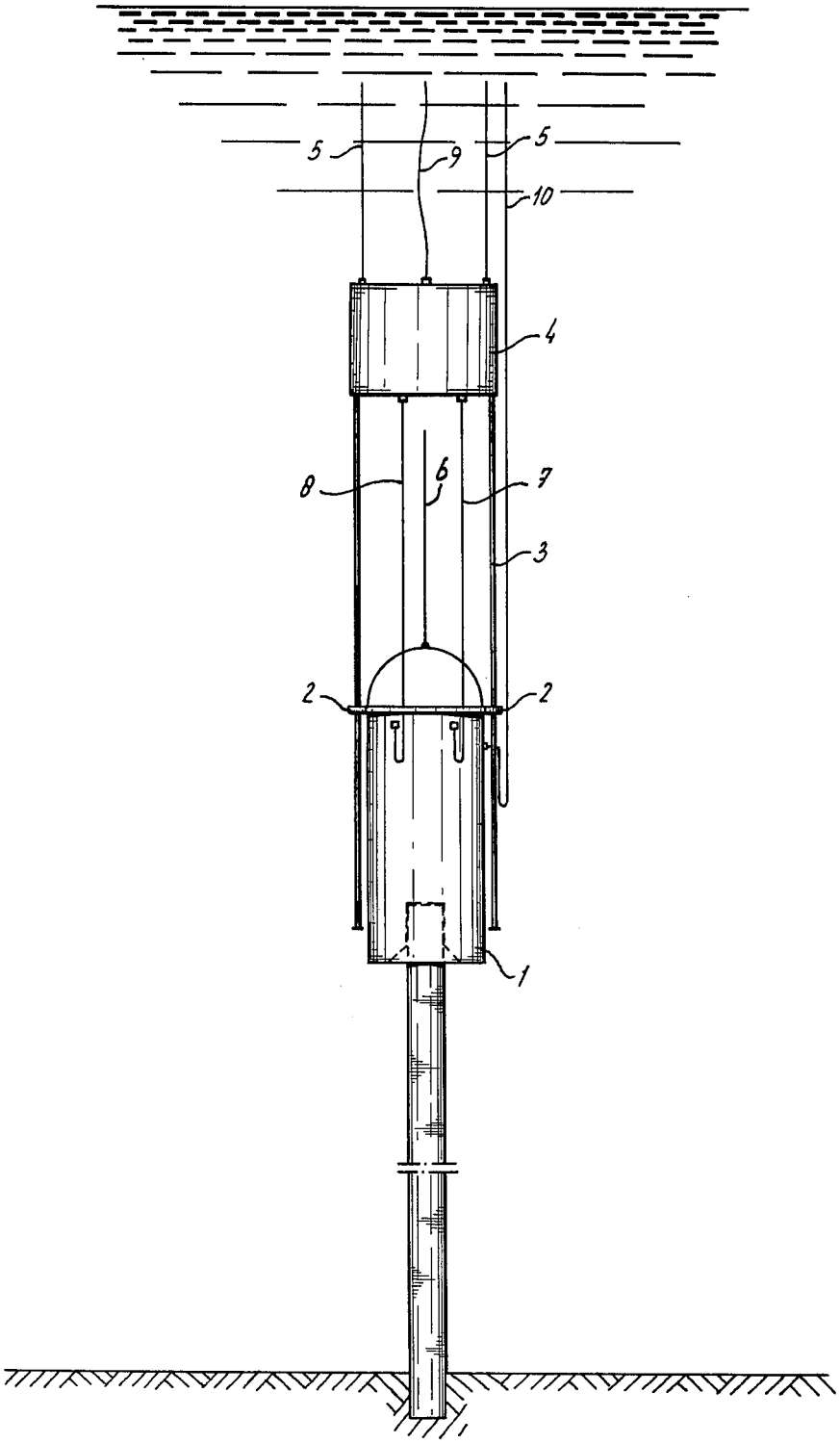
5
9
5
10
4
8
6
7
3
2
2
1

UNDER WATER PILE DRIVER

The invention relates to an under water pile-driver, consisting of a pile hammer and a drive unit, movable with regard to one another and suspended from a hoisting apparatus, such that the energy of the drive unit is transmitted via flexible connections to the pile hammer. Such a device is known from published Dutch patent application No. 7513240, in which the drive unit is coupled to the pile hammer via elastic connections so that the drive unit endures as little strain as possible from the shocks and vibrations caused by the hammer. However, it is hereby contested that this purpose is not sufficiently achieved and that the invention provides a better solution.

The improvement in accordance with the invention is achieved by the pile hammer being vertically guided within an auxilary frame to which the drive unit is permanently attached.

Pile hammers which have been vertically guided in an auxiliary frame are described in published Dutch patent application Nos. 7410905, 7512023 and 7514331. They all show the drive unit to be above water level. Long high pressure hoses are obviously needed for pile-driving at great depths. If the drive unit and pile hammer are closely situated together short high pressure hoses will suffice and all that is further needed is a supply of electrical energy from the ship above the water to the drive unit below. If, at the same time, an air pressure supply is utilized only one air pressure hose is needed to go to the pile hammer located within a driving bell.

This known combination of drive unit and pile hammer cannot prevent damage to the drive unit and the interconnecting high pressure conduits due to unavoidable vibrations and undesired relative movements caused by the ramming process itself. These vibrations produce sudden movements of the pile hammer on top of the pile and consequently of the drive unit as well, assuming it is placed on top; even with elastic means between the hammer and drive unit.

According to the invention when the pile hammer is guided within an auxiliary frame and the drive unit is attached to this frame it now surprisingly appears that with slightly longer but still relatively short high pressure hoses between the drive unit and pile hammer a protected position of the drive unit is achieved and it is no longer exposed to vibrations and shocks. The drive unit and frame hang together on a hoisting apparatus and are not shaken anymore by vertical power components resulting from the shocks and vibrations. At most, a small portion of diagonal power components are endured under certain circumstances, originating at the pile hammer and transmitted to the auxiliary frame.

The invention will now be further elucidated with reference to the drawing.

This drawing shows a pile hammer 1, which is vertically guided by guiding eyelets 2 into an auxiliary frame 3, on top of which is the drive unit 4, in turn suspended by hoisting cables 5.

6 is a hoisting cable to be used for the pile hammer—if necessary. However, in most cases there will be no need for it.

7 and 8 are high pressure hoses between drive unit 4 and hammer 1, 9 is an electric cable going to the drive unit 4 and 10 is an air pressure hose going to the driving bell, inside of which the pile hammer is situated. The air pressure hose 10 can also be connected to the drive unit 4, if it is constructed like a block.

I claim:

1. An apparatus for underwater pile driving, comprising:

(a) a submersible drive unit (b) means suspending the drive unit from a surface vessel or platform.

(c) auxiliary frame means permanently attached to and depending downwardly from the drive unit, (d) a pile hammer operatively disposed below the drive unit and guided within the auxilliary frame for vertical movement relative to the drive unit, and (e) flexible high pressure conduit means connected between the drive unit and the pile hammer for transmitting energy generated within the drive unit to the pile hammer, whereby shocks and vibrations developed during impacts of the pile hammer are substantially isolated from the drive unit.

2. An apparatus as claimed in claim 1, wherein the auxilliary frame comprises a plurality of guide rods, and the pile hammer is provided with a flange member having apertures through which the guide rods extend.

3. An apparatus as claimed in claims 1 or 2, further comprising an electrical cable coupling power from a source on the surface to the drive unit.

* * * * *